US009316373B2

(12) United States Patent
Okui et al.

(10) Patent No.: US 9,316,373 B2
(45) Date of Patent: Apr. 19, 2016

(54) VEHICULAR LAMP

(75) Inventors: Kazuki Okui, Shizuoka (JP); Akio Inoue, Shizuoka (JP); Tomoharu Yamazaki, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 1398 days.

(21) Appl. No.: 13/075,935

(22) Filed: Mar. 30, 2011

(65) Prior Publication Data

US 2011/0242831 A1 Oct. 6, 2011

(30) Foreign Application Priority Data

Mar. 31, 2010 (JP) ..... 2010-082523

(51) Int. Cl.
*F21S 8/10* (2006.01)

(52) U.S. Cl.
CPC ..... *F21S 48/115* (2013.01); *F21S 48/1241* (2013.01); *F21S 48/215* (2013.01); *F21S 48/2237* (2013.01); *F21S 48/2268* (2013.01); *F21S 48/2281* (2013.01)

(58) Field of Classification Search
CPC .. G02B 6/0001; G02B 6/0016; G02B 6/0018; B60Q 1/00; B60Q 1/2665; B60Q 3/023; F21S 48/2225; F21S 48/215; F21S 48/22; F21S 48/2231; F21S 48/225; F21S 48/115; F21S 48/1241; F21S 48/2237; F21S 48/2268; F21S 48/2281; F21W 2101/00
USPC ..... 362/459, 487, 511, 520–522, 620, 623, 362/626, 545
See application file for complete search history.

(56) References Cited

U.S. PATENT DOCUMENTS

| | | | | |
|---|---|---|---|---|
| 5,432,876 | A | 7/1995 | Appeldorn et al. | |
| 6,268,600 | B1 * | 7/2001 | Nakamura et al. | 250/216 |
| 6,769,798 | B2 * | 8/2004 | Mishimagi | 362/522 |
| 7,040,787 | B2 * | 5/2006 | Pommeret et al. | 362/496 |
| 7,529,048 | B2 * | 5/2009 | Lin | 359/831 |
| 7,762,706 | B2 * | 7/2010 | Okuwaki | 362/625 |
| 8,240,902 | B2 * | 8/2012 | Fujimoto et al. | 362/559 |
| 8,632,232 | B2 * | 1/2014 | Okui | F21S 48/115 362/459 |
| 2004/0136198 | A1 * | 7/2004 | Wimbert et al. | 362/507 |

(Continued)

FOREIGN PATENT DOCUMENTS

JP 06-201917 A 7/1994

OTHER PUBLICATIONS

English abstract of JP6201917 published on Jul. 22, 1994, espacenet database, 1 page.

*Primary Examiner* — Stephen F Husar
(74) *Attorney, Agent, or Firm* — Osha Liang LLP

(57) ABSTRACT

A light guide includes a first incident portion at an end side thereof near a light source, a stepped portion disposed on a rear surface side thereof in an axial direction and wholly reflects a portion of guided light, and a radiating portion disposed on a front surface side thereof in the axial direction that radiates the wholly reflected light forward. The light guide guides light that is incident through the first incident portion from front to back within the light guide. The stepped portion is a plurality of generally triangular prisms formed continuous in an extension direction, and has, in a cross section that follows an extension axis of the light guide and is parallel to a lamp optical axis, a long first projection surface that extends in the extension direction and a short second projection surface that forms an apex angle with the first projection surface.

10 Claims, 8 Drawing Sheets

(56) References Cited

U.S. PATENT DOCUMENTS

2004/0208016 A1* 10/2004 Kazaoka et al. ..... 362/511
2005/0243568 A1* 11/2005 Rodriguez Barros et al. ..... 362/494
2006/0193144 A1* 8/2006 Braeutigam et al. ..... 362/493
2008/0232127 A1* 9/2008 Futami ..... 362/511
2009/0201675 A1* 8/2009 Onishi et al. ..... 362/223
2009/0207344 A1* 8/2009 Ono et al. ..... 349/65
2009/0219586 A1* 9/2009 Fujimoto et al. ..... 358/494
2010/0254152 A1* 10/2010 Taleb-Bendiab et al. ..... 362/551

* cited by examiner

B - B

VEHICULAR LAMP

BACKGROUND OF INVENTION

1. Field of the Invention

The present invention relates to a vehicular lamp of an automobile or the like, and, more specifically, relates to a vehicular lamp in which light from an LED light source is made incident to a light guide disposed nearby and radiated in an illumination direction from the light guide.

2. Related Art

A conventionally known light emitting device (Patent Document 1, for example) is a light guide in which a triangular notch, that is, a step, is formed on a rear surface side of a light emitting region. By using this notch to form a reflective surface at a predetermined angle, light transmitted from a light source is wholly reflected by the reflective surface and radiated from a front surface side in a predetermined direction.

[Patent Document 1] Japanese Patent Application Laid-Open (Kokai) No. H06-201917

SUMMARY OF INVENTION

However, in the light guide described above, a portion of the light incident to the reflective surface at an angle greater than a reflection critical angle may return from another adjacent reflective surface to the inside of the light guide. Other light passes through the reflective surface and exits from the rear surface side, making it difficult to improve the use efficiency of light from the light source.

One or more embodiments of the present invention provide a vehicular lamp that can improve a use efficiency of light from a light source by returning light exiting from a rear surface side of a light guide to inside the light guide and radiating such light in an illumination direction.

One or more embodiments of the present invention relate to a vehicular lamp including: a first light source within a lamp chamber defined by a lamp body and a front cover; a columnar light guide disposed so as to slant from front to back; and a reflector disposed adjacent to at least a rear side of the columnar light guide. The columnar light guide has a first incident portion disposed on an end side thereof near the first light source, a stepped portion disposed on a rear surface side thereof in an axial direction and wholly reflects a portion of guided light, and a radiating portion disposed on a front surface side thereof in the axial direction that radiates the wholly reflected light forward. The columnar light guide is disposed so as to guide light from the first light source that is incident through the first incident portion from front to back within the light guide. The stepped portion is a plurality of generally triangular prisms formed continuous in an extension direction, and has, in a cross section that follows an extension axis of the columnar light guide and is parallel to a lamp optical axis, a long first projection surface that extends in the extension direction and a short second projection surface that forms an apex angle with the first projection surface.

According to the vehicular lamp with the configuration described above, the stepped portion is a plurality of generally triangular prisms formed continuous in the extension direction, and has, in the cross section that follows the extension axis of the columnar light guide and is parallel to the lamp optical axis, the long first projection surface that extends in the extension direction and the short second projection surface that forms an apex angle with the first projection surface. Thus, incident light from the first light source exits from the second projection surface of the columnar light guide, and is reflected by the reflector. Such light is re-incident from another non-adjacent first projection surface, after which the light is wholly reflected by the second projection surface adjacent to that first projection surface and irradiated forward from the radiating portion. Accordingly, even if the columnar light guide is slantingly disposed, light from the first light source can be efficiently radiated forward of the lamp, thus improving a use efficiency of the light source. It should be noted that the extension axis of the columnar light guide here is a center axis that passes through the center of the columnar light guide along the extension direction of the columnar light guide.

In one or more embodiments of the vehicular lamp with the configuration described above, the first projection surface in the columnar light guide preferably projects forward.

According to the vehicular lamp thus configured, the first projection surface is not a single flat surface, and is instead formed by a curved surface or a plurality of flat surfaces to project forward. Therefore, the second projection surface can have a larger surface area. Thus, the amount of light exiting from the second projection surface to the reflector side can be increased, and such light can be even more efficiently radiated forward of the lamp from the first light source.

In one or more embodiments of the vehicular lamp with the configuration described above, it is preferable that the columnar light guide has a second incident portion disposed on another end side thereof, and a second light source is provided near the second incident portion. It is further preferable that light from the second light source is guided from back to front within the light guide through the second incident portion, and a portion of the guided light from the second incident portion is wholly reflected by the first projection surface and radiated forward from the radiating portion.

According to the vehicular lamp thus configured, incident light from the second light source exits from the first projection surface of the columnar light guide, and is reflected by the reflector. Such light is subsequently re-incident from another non-adjacent second projection surface. The light is then wholly reflected by the first projection surface adjacent to that second projection surface, and irradiated forward from the radiating portion. Thus, the columnar light guide can evenly emit light at a high intensity.

In one or more embodiments of the vehicular lamp with the configuration described above, the first projection surface is preferably constituted from two flat surfaces, wherein among the two flat surfaces in the cross section that follows the extension axis of the columnar light guide, if L2 is a side length of the forward flat surface and L1 is a side length of the rearward flat surface, a ratio L2/L1 of the side lengths is set so as to increase from the first incident portion toward the second incident portion.

According to the vehicular lamp thus configured, from the first incident portion toward the second incident portion, the side length L2 of the forward flat surface gradually becomes longer than the side length L1 of the rearward flat surface. Thus, the first projection surface that internally reflects incident light from the second light source can have a reflection surface area that increases toward the second incident portion. Therefore, a portion far from the first light source can be compensated by the second light source, and the overall columnar light guide can more evenly emit light.

In one or more embodiments of the vehicular lamp with the configuration described above, it is preferable that a portion of light from the first light source that is guided from front to back in the columnar light guide is radiated from the second projection surface and reflected by the reflector, and then incident to another first projection surface and wholly reflected by the second projection surface adjacent to the first projection surface, and subsequently radiated forward from the radiating portion.

According to the vehicular lamp thus configured, the second projection surface having a relatively large surface area is used for radiating light to the reflector and for internal reflecting incident light, whereby the amount of light exiting to the reflector side can be increased and the amount of light internally reflected forward toward the radiating portion can also be increased.

In one or more embodiments of the vehicular lamp with the configuration described above, the columnar light guide is preferably disposed along the front cover.

According to the vehicular lamp thus configured, incident light from the first light source is actively radiated to the reflector side, and then reflected by the reflector and returned to inside the light guide. Thereafter, such light passes through the front cover and can be efficiently radiated forward of the lamp. This is achieved with particular effectiveness in the columnar light guide that is slantingly disposed.

According to a vehicular lamp of one or more embodiments of the present invention, incident light from a first light source exits from a second projection surface of a columnar light guide and is reflected by a reflector, after which such light is re-incident from another non-adjacent first projection surface. The light is then wholly reflected by the second projection surface adjacent to that first projection surface and radiated forward. Thus, even if the columnar light guide is slantingly disposed, a use efficiency of light from a light source can be improved by returning light exiting from a rear surface side of the light guide to inside the light guide and efficiently radiating such light in an illumination direction forward of the lamp.

Other aspects and advantages of the invention will be apparent from the following description, the drawings and the claims.

DETAILED DESCRIPTION

Hereinafter, embodiments of a vehicular lamp according to the present invention will be described based on FIGS. 1 to 8.

Figure 1:
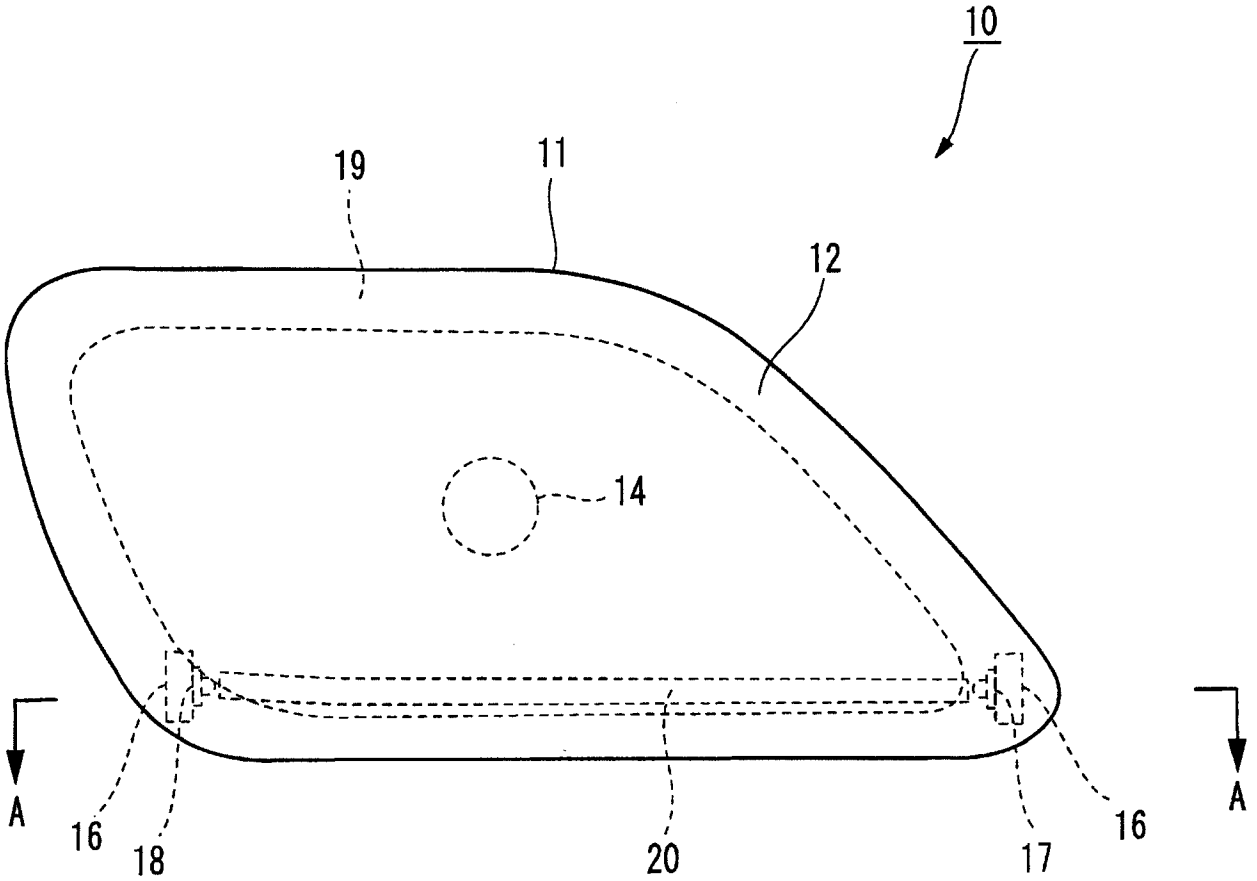
FIG. 1 is a frontal view of a vehicular lamp that shows an embodiment of the present invention.
Figure 2:
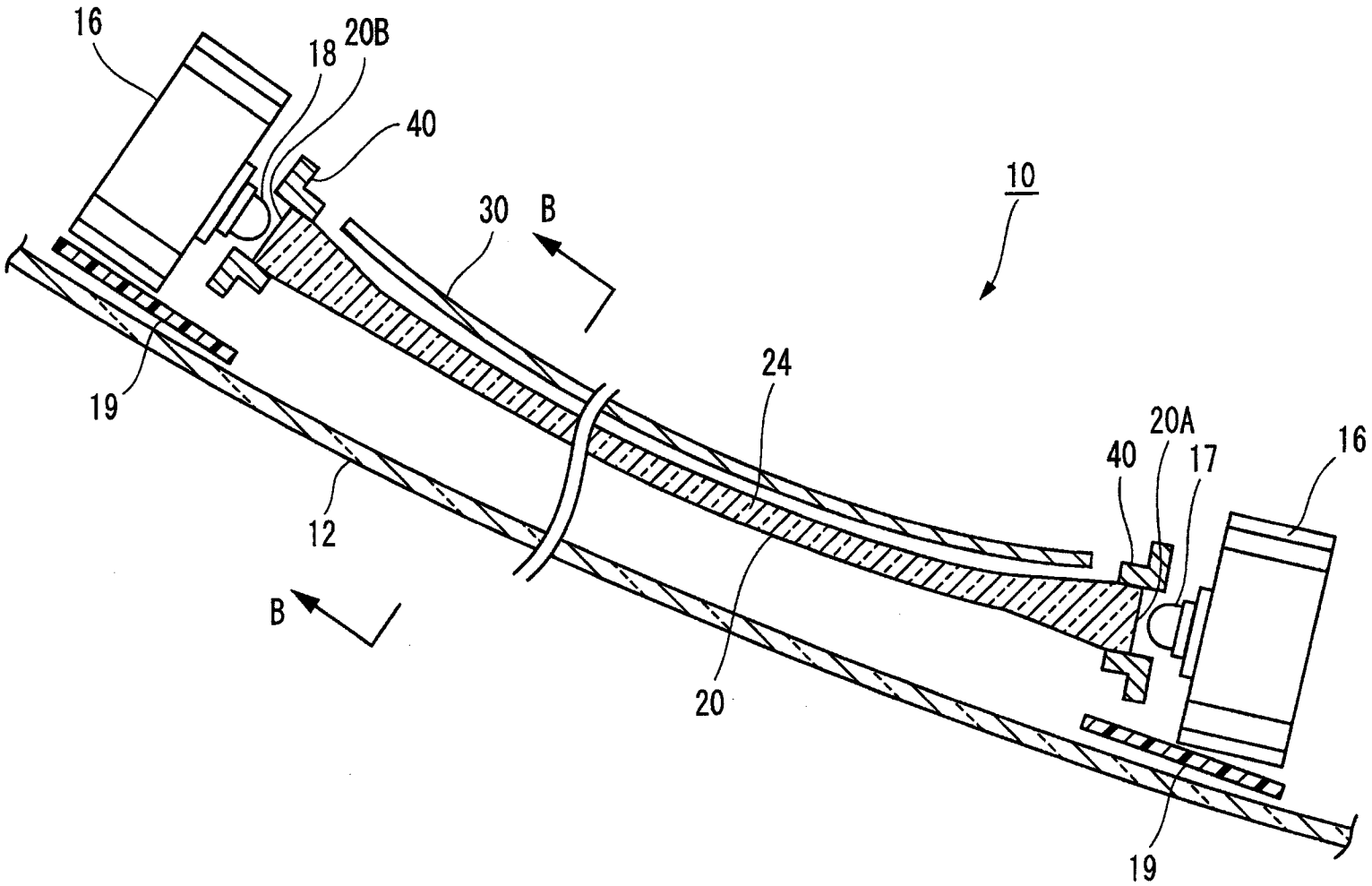
FIG. 2 is a cross-sectional view taken along a line A-A in FIG. 1.

As shown in FIGS. 1 and 2, a vehicular lamp 10 applied to an indicator lamp of a headlamp that includes a resin lamp body 11 that is fixed to a vehicle body side and whose vehicle front side is formed open, and a colorless and transparent front cover 12 that is attached to an opening portion of the lamp body 11.

The vehicular lamp 10 further includes a bulb 14 for the headlamp, which is disposed at a center portion inside a lamp chamber that is defined by the lamp body 11 and the front cover 12. The front cover 12 is disposed so as to slant from front to back, that is, from the vehicle body center (right side in the figure) toward the vehicle body side (left side in the figure), and a light guide 20 that is a columnar light guide is disposed curved along the front cover 12. In addition, a reflector 30 is disposed curved near a rear surface side of the light guide 20 such that a predetermined distance is maintained between the light guide 20 and the reflector 30.

The light guide 20 is made of acrylic resin. Both end portions of the light guide 20 respectively have incident portions 20A, 20B to which light from LED light sources 17, 18 is incident, and an intermediate portion of the light guide 20 has a light guiding portion 24 that guides incident light. A heat radiating member (e.g., heat sink) 16 is attached near both ends of the light guide 20. The LED light sources 17, 18, and the end portions of the light guide 20 via plate-like members 40 are respectively fixed to side surface portions of the heat sinks 16. Light distribution for a position lamp, for example, is formed by the forwardly disposed first LED light source 17, the rearwardly disposed second LED light source 18, and the light guide 20. An extension 19 is also disposed around the opening portion of the lamp body 11.

Figure 3:
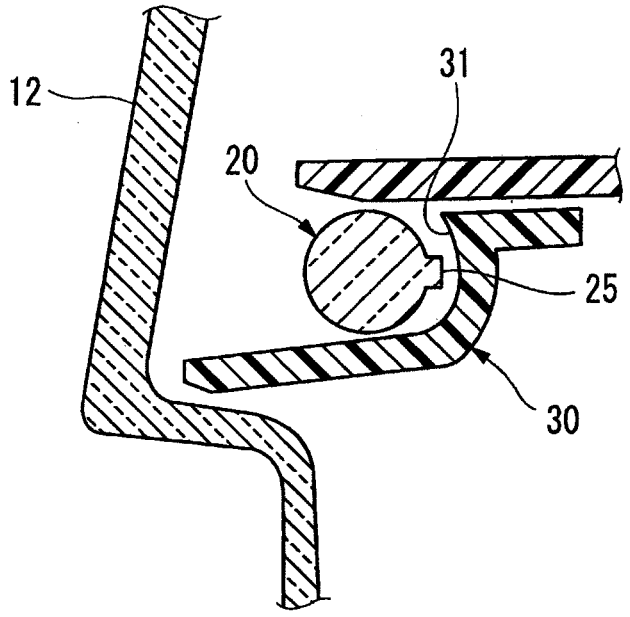
FIG. 3 is a cross-sectional view taken along a line B-B in FIG. 2.

As shown in FIGS. 2 and 3, the reflector 30 has a curved shape that corresponds to the shape of the curved light guide 20 in the lengthwise direction. Excluding the front of the light guide 20, the reflector 30 is provided so as to bend from upwardly rearward and extend forwardly downward to just behind the front cover 12. The material of the reflector 30 is formed with a reflective surface 31 that is an aluminized film on a resin substrate formed of a polymer material or the like. The reflector 30 has a function for reflecting light exiting from the rear surface of the light guide 20 to inside the light guide 20.

Figure 4:
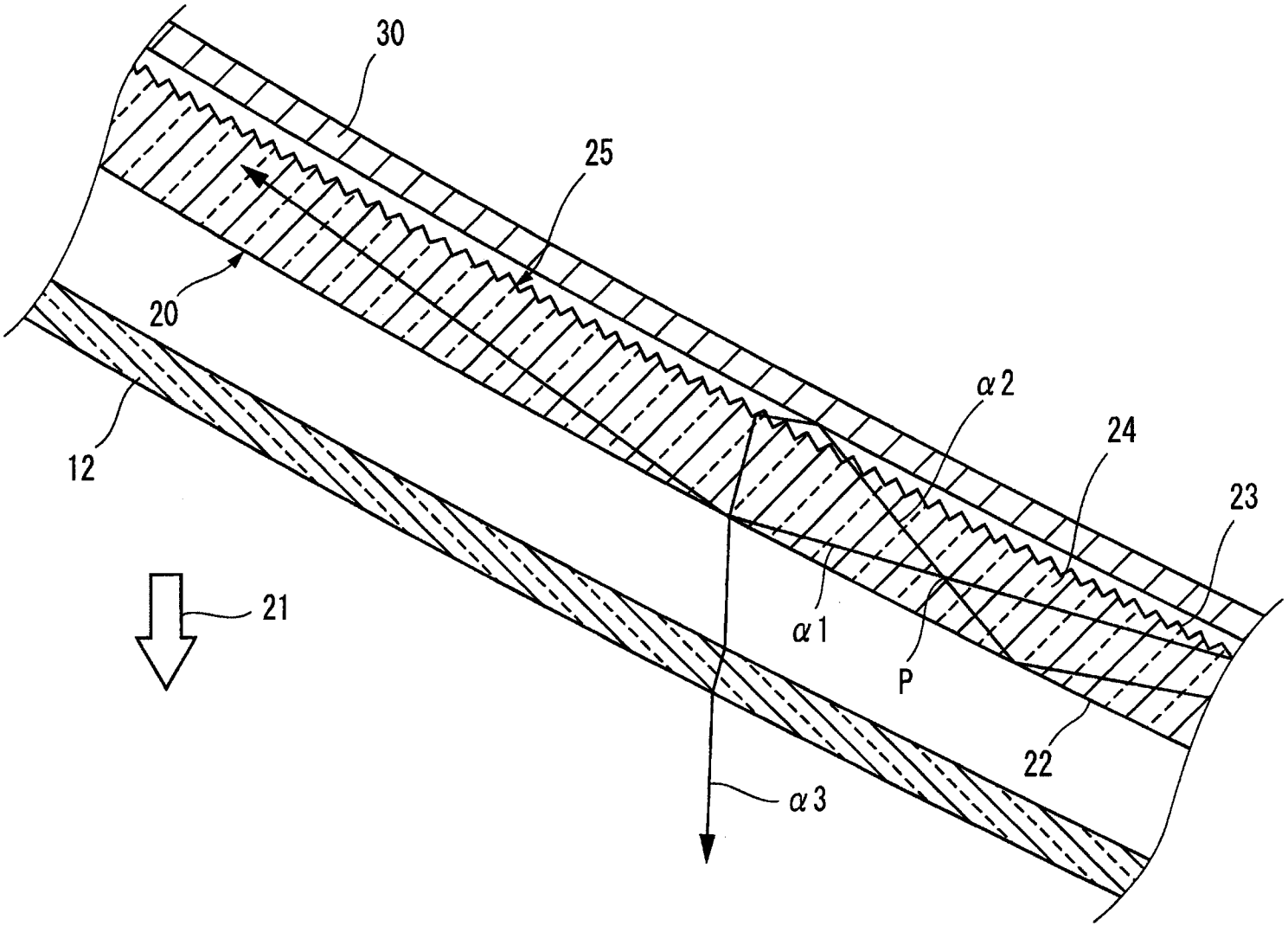
FIG. 4 is an enlarged view of an essential portion of FIG. 2, and shows a light path from a first light source.

As shown in FIGS. 3 and 4, light $\alpha 1$, $\alpha 2$ from the first LED light source 17 advances from front (the right side of the figure) to back (the left side of the figure) while being guided inside the light guiding portion 24 along an extension axis along which the light guide 20 extends. On a rear surface 23 side of the light guide 20, a plurality of triangular prism-like diffusion steps 25 is formed in a band configuration along the extension axis. The diffusion step 25 internally reflects a portion of light from the LED light source 17 and radiates such light from a radiating portion 22 side disposed on a front surface side of the light guiding portion 24 in an illumination direction 21 that serves as a lamp optical axis.

Figure 5:
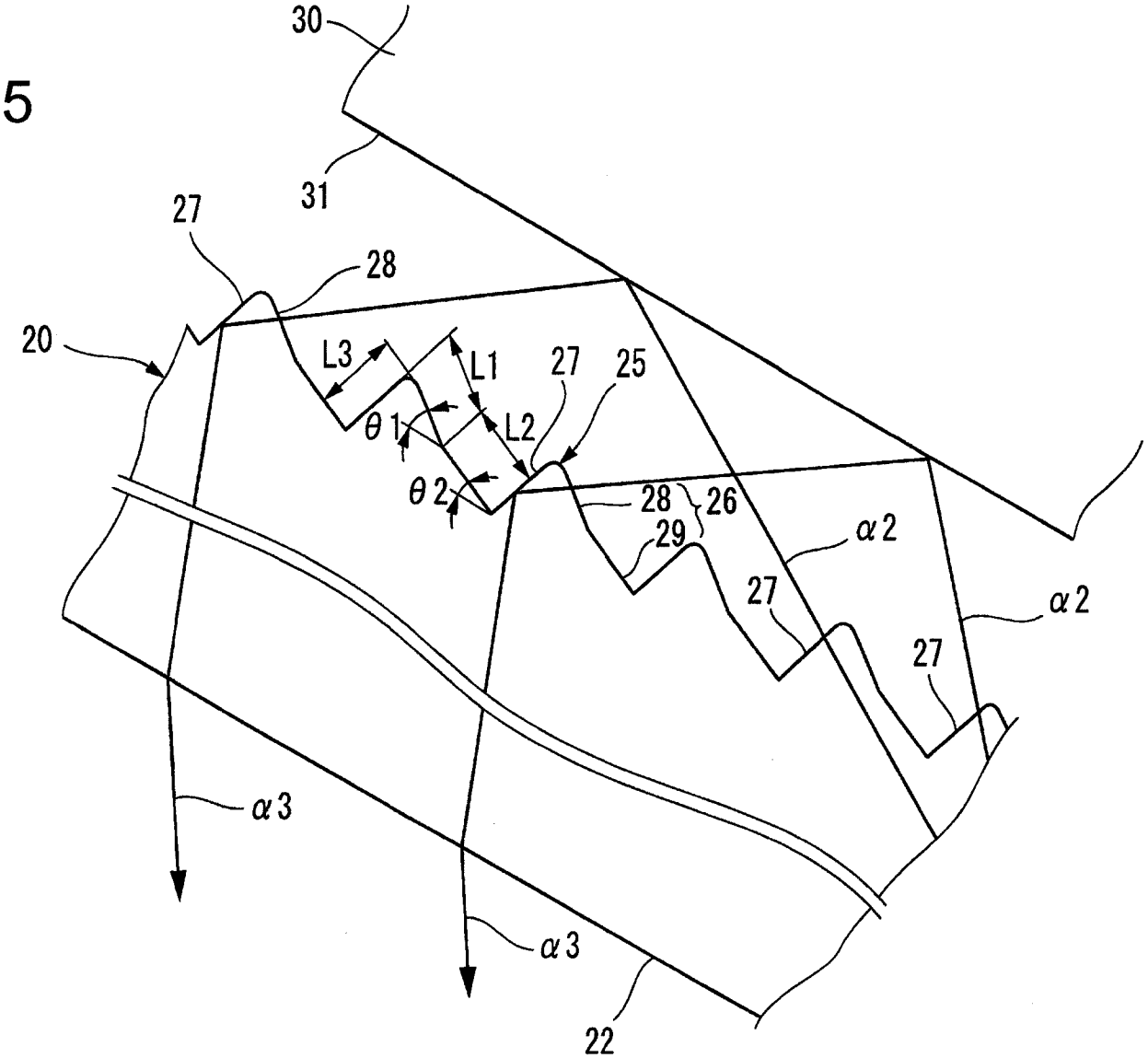
FIG. 5 is an enlarged view of FIG. 4.

As shown in FIGS. 4 and 5, in a cross section that is parallel to the lamp optical axis and follows the extension axis of the light guide 20, a single diffusion step 25 has a long first projection surface 26 that projects rearward with respect to the extension axis of the light guide 20 from front to back in an extending direction (toward the left side of the figure), and a short second projection surface 27 that is disposed so as to form an apex angle with the first projection surface 26. Further, the first projection surface 26 is constituted from a first flat surface 28 that has an inclination angle $\theta 1$ and a length L1, and a second flat surface 29 that has an inclination angle $\theta 2$ and a length L2.

That is, the side length of the first projection surface 26 is L1+L2, and its relationship with a side length L3 of the second projection surface 27 is L1+L2>L3. In addition, the relationship between the inclination angle $\theta 1$ of the first flat surface 28 and the inclination angle $\theta 2$ of the second flat surface is $\theta 1 > \theta 2$. Thus, the first projection surface 26 is a discontinuous surface that projects forward to the radiating portion 22 side, and the second projection surface 27 can have a long length L3. It should be noted that the inclination angles θ1, θ2 are angles respectively formed between the extension axis (or the radiating portion 22) of the light guide 20 and the flat surfaces 28, 29.

The relationship between the length L1 of the first flat surface 28 and the length L2 of the second flat surface 29 is also set such that the value of the length ratio L2/L1 increases from the first incident portion 20A on the first LED light source 17 side toward the second incident portion 20B on the second LED light source 18 side. That is, the length L2 of the second flat surface 29 that forms the first projection surface 26 gradually becomes longer toward the second LED light source 18 side compared to the length L1 of the first flat surface 28 (L2>L1).

The light α1, α2 from the first LED light source 17 is guided from front (the right side in the figure) to back (the left side in the figure) while being reflected within the light guiding portion 24. The light al that passes through a virtual light source P assumed on the extension axis of the light guide 20 is further guided within the light guiding portion 24 while being wholly reflected rearward toward the second LED light source 18 side.

The light α2 that passes through the virtual light source P is radiated from the second projection surface 27 of the diffusion step 25, and reflected by the reflective surface 31 of the reflector 20 to the light guide 20 side. Such light is mainly incident from the first flat surface 28 of the first projection surface 26, and following internal reflection by the adjacent second projection surface 27, radiated from the radiating portion 22 in the illumination direction 21 as radiated light α3.

Next, light guided from the second LED light source 18 will be described. Note that like reference numerals are used for structural members and effects that are identical to those in FIGS. 4 and 5, which will not be described further here.

Figure 6:
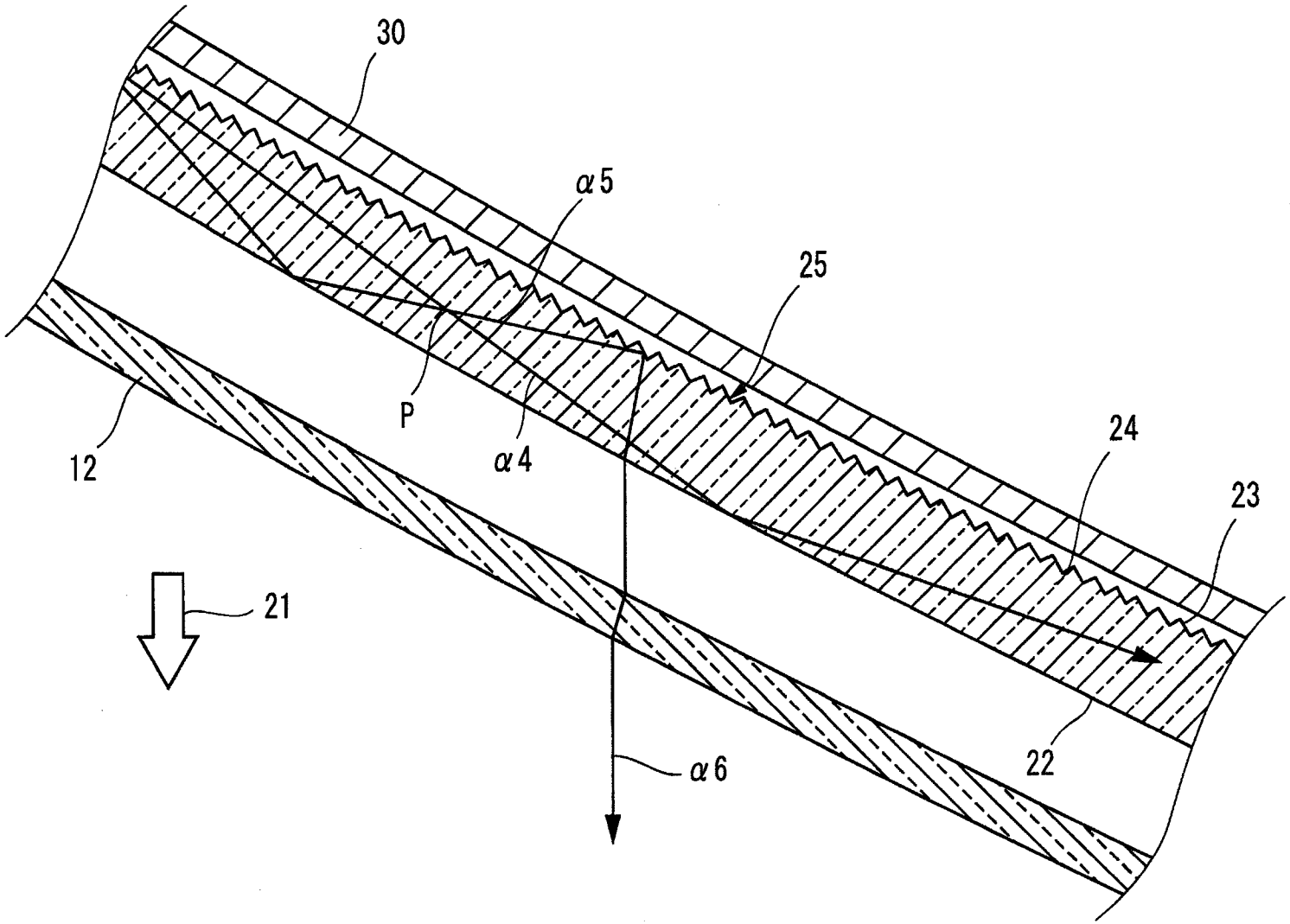
FIG. 6 is an enlarged view of an essential portion of FIG. 2, and shows a light path from a second light source.
Figure 7:
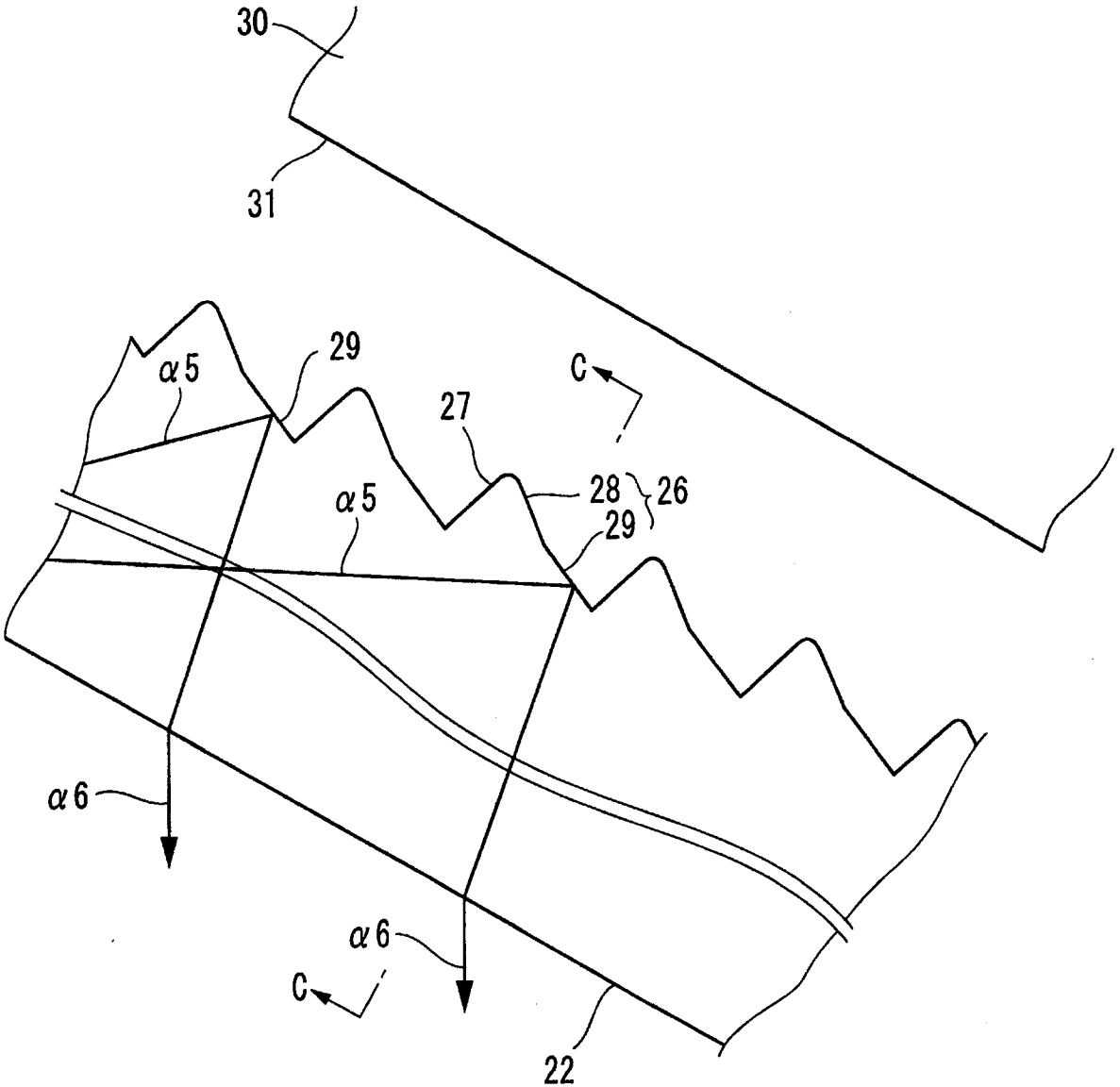
FIG. 7 is an enlarged view of FIG. 6.

As shown in FIGS. 6 and 7, the light guide 20 has the second incident portion 20B disposed at a rear end thereof (left side of the figure), and the second LED light source 18 is provided near the second incident portion 20B. Light α4, α5 from the second LED light source 18 is guided from back (the left side in the figure) to front (the right side in the figure) within the light guiding portion 24 through the second incident portion 20B.

Figure 8:
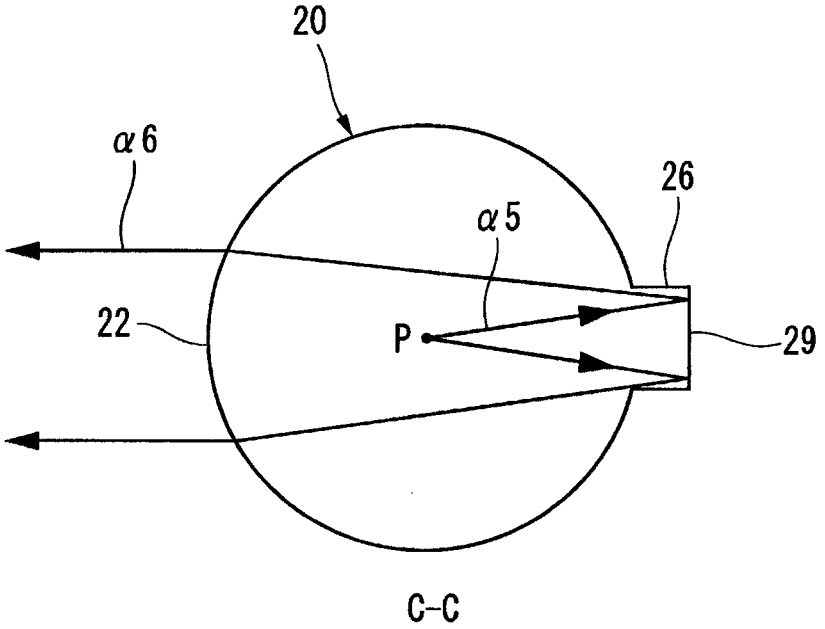
FIG. 8 is a cross-sectional view taken along a line C-C in FIG. 7.

As shown in FIGS. 7 and 8, the light α4 that passes through the virtual light source P assumed on a center axis of the light guide 20 is further guided within the light guiding portion 24 while being wholly reflected forward toward the first LED light source 17 side. Thereafter, such light is radiated from the first flat surface 28 or the second flat surface 29 of the first projection surface 26, and then re-incident from the forwardly adjacent second projection surface 27 (the right side of FIG. 7). Following internal reflection by the first flat surface 28 or the second flat surface 29 of the adjacent first projection surface 26, such light is radiated from the radiating portion 22 in the illumination direction 21 (not shown). In addition, the light α5 that passes through the virtual light source P is mainly internally reflected by the second flat surface 29 of the first projection surface 26 and subsequently radiated from the radiating portion 22 in the illumination direction 21 as radiated light α6.

According to the vehicular lamp 10 described above, in a cross section that follows the extension axis of the light guide 20 and is parallel to the illumination direction 21 serving as the lamp optical axis, the diffusion step 25 has the long first projection surface 26 that extends in the extension direction, and the short second projection surface 27 that forms an apex angle with the first projection surface 26. Thus, incident light from the first LED light source 17 is radiated from the second projection surface 27 of the light guide 20, and reflected by the reflective surface 31 of the reflector 30. Such light is incident from another non-adjacent first projection surface 26, after which the light is internally reflected by the second projection surface 27 adjacent to that first projection surface 26 and irradiated forward from the radiating portion 22 that serves as a radiating portion. Accordingly, even if the light guide 20 is slantingly disposed, light from the first LED light source 17 can be efficiently radiated forward of the lamp, thus improving a use efficiency of the first LED light source 17.

The first projection surface 26 is not a single flat surface, and is instead a discontinuous surface constituted from the first flat surface 28 and the second flat surface 29. By forming the first projection surface 26 so as to project forward, the second projection surface 27 can have a larger surface area. Thus, the amount of light exiting from the second projection surface 27 to the reflector 30 side can be increased, and such light can be even more efficiently radiated forward of the lamp from the first LED light source 17.

The light guide 20 has the second incident portion 20B disposed on another end side thereof, and the second LED light source 18 is provided near the second incident portion 20B. Light from the second LED light source 18 is guided from back to front within the light guide 20 through the second incident portion 20B. Thus, incident light from the second LED light source 18 is radiated from the first projection surface 26 of the light guide 20, reflected by the reflective surface 31 of the reflector 30, and then incident from another non-adjacent second projection surface 27. Such light is then internally reflected by the first projection surface 26 adjacent to that second projection surface 27, and irradiated forward from the radiating portion 22. Thus, the light guide 20 can evenly emit light at a high intensity.

In a cross section that follows the center axis of the light guide 20, the value of the ratio L2/L1 for the two lengths L1, L2 of the first flat surface 28 and the second flat surface 29 is set so as to increase from the first incident portion 20A toward the second incident portion 20B. Accordingly, a portion far from the first LED light source 17 can be compensated by the second LED light source 18, and the first projection surface 26 that internally reflects incident light from the second LED light source 18 can have a reflection surface area that increases toward the second incident portion 20B. Thus, the overall light guide 20 can more evenly emit light.

The light guide 20 is disposed along the front cover 12. Therefore, incident light from the first LED light source 17 is actively radiated to the reflector 30 side, and then reflected by the reflective surface 31 of the reflector 30 and returned to inside the light guide 20. Thereafter, such light passes through the front cover 12 and can be efficiently radiated forward of the lamp. This is achieved with particular effectiveness in the light guide 20 that is slantingly disposed.

Note that the present invention is not limited to the embodiments described above, and may be freely modified, improved, and so forth as appropriate. In addition, the structural elements used in the embodiments described above are not limited in terms of material, shape, dimension, value, form, number, layout, or the like, provided that any structural elements used are capable of achieving the present invention.

For example, the first projection surface 26 is not limited to two flat surfaces (the first flat surface 28 and the second flat surface 29). The first projection surface 26 may be configured with three or more flat surfaces, or have a recessed shape that simply projects forward (a shape resembling a cylindrical shape), or be curved such that the two, three, or more flat surfaces each project forward. In such case, when light from the second LED light source 18 is wholly reflected by the first projection surface, such wholly reflected light is diffused, and by disposing the extension axis of the light guide 20 in the horizontal direction as shown in FIGS. 1 and 2, can easily satisfy a horizontally long light distribution requirement demanded of a vehicular lamp.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

10 VEHICULAR LAMP
12 FRONT COVER
17 FIRST LED LIGHT SOURCE
18 SECOND LED LIGHT SOURCE
20 LIGHT GUIDE (COLUMNAR LIGHT GUIDE)
20A FIRST INCIDENT PORTION
20B SECOND INCIDENT PORTION
24 LIGHT GUIDING PORTION
25 DIFFUSION STEP
26 FIRST PROJECTION SURFACE
27 SECOND PROJECTION SURFACE
28 FIRST FLAT SURFACE
29 SECOND FLAT SURFACE
30 REFLECTOR
31 REFLECTIVE SURFACE
L1 SIDE LENGTH OF FIRST FLAT SURFACE
L2 SIDE LENGTH OF SECOND FLAT SURFACE
L3 SIDE LENGTH OF SECOND PROJECTION SURFACE

What is claimed is:

1. A vehicular lamp comprising:

a first light source within a lamp chamber defined by a lamp body and a front cover;

a columnar light guide disposed so as to slant from front to back; and a reflector disposed adjacent to at least a rear side of the columnar light guide, wherein the columnar light guide comprises:

a first incident portion disposed on an end side thereof near the first light source, a stepped portion disposed on a rear surface side thereof in an axial direction and wholly reflects a portion of guided light, and a radiating portion disposed on a front surface side thereof in the axial direction that radiates the wholly reflected light forward, wherein the columnar light guide is disposed so as to guide light from the first light source that is incident through the first incident portion from front to back within the light guide, and wherein the stepped portion is a plurality of generally triangular prisms formed continuous in an extension direction, wherein the stepped portion has, in a cross section that follows an extension axis of the columnar light guide and is parallel to a lamp optical axis, a long first projection surface that extends in the extension direction and a short second projection surface that forms an apex angle with the first projection surface, wherein a portion of light from the first light source that is guided from front to back in the columnar light guide is radiated from the second projection surface and reflected by the reflector, and then incident to another first projection surface and wholly reflected by the second projection surface adjacent to the first projection surface, and subsequently radiated forward from the radiating portion, wherein the columnar light guide comprises a second incident portion disposed on another end side thereof, the vehicular lamp further comprising a second light source provided near the second incident portion, wherein light from the second light source is guided from back to front within the light guide through the second incident portion, and wherein a portion of the guided light from the second incident portion is wholly reflected by the first projection surface and radiated forward from the radiating portion, wherein the first projection surface is constituted from two flat surfaces, and wherein among the two flat surfaces in the cross section that follows the extension axis of the columnar light guide, where L2 is a side length of the forward flat surface and L1 is a side length of the rearward flat surface, a ratio L2/L1 of the side lengths is set so as to increase from the first incident portion toward the second incident portion.

2. The vehicular lamp according to claim 1, wherein the columnar light guide is disposed along the front cover.

3. A vehicular lamp comprising:

a first light source within a lamp chamber defined by a lamp body and a front cover;

a columnar light guide disposed so as to slant from front to back; and a reflector disposed adjacent to at least a rear side of the columnar light guide, wherein the columnar light guide comprises:

a first incident portion disposed on an end side thereof near the first light source, a stepped portion disposed on a rear surface side thereof in an axial direction and wholly reflects a portion of guided light, and a radiating portion disposed on a front surface side thereof in the axial direction that radiates the wholly reflected light forward, wherein the columnar light guide is disposed so as to guide light from the first light source that is incident through the first incident portion from front to back within the light guide, and wherein the stepped portion is a plurality of generally triangular prisms formed continuous in an extension direction, wherein the stepped portion has, in a cross section that follows an extension axis of the columnar light guide and is parallel to a lamp optical axis, a long first projection surface that extends in the extension direction and a short second projection surface that forms an apex angle with the first projection surface, and wherein a portion of light from the first light source that is guided from front to back in the columnar light guide is radiated from the second projection surface and reflected by the reflector, and then incident to another first projection surface and wholly reflected by the second projection surface adjacent to the first projection surface, and subsequently radiated forward from the radiating portion.

4. The vehicular lamp according to claim 3, wherein the first projection surface in the columnar light guide projects forward.

5. The vehicular lamp according to claim 3, wherein the columnar light guide comprises a second incident portion disposed on another end side thereof, the vehicular lamp further comprising a second light source provided near the second incident portion, wherein light from the second light source is guided from back to front within the light guide through the second incident portion, and wherein a portion of the guided light from the second incident portion is wholly reflected by the first projection surface and radiated forward from the radiating portion.

6. The vehicular lamp according to claim 4, wherein the columnar light guide comprises a second incident portion disposed on another end side thereof, the vehicular lamp further comprising a second light source provided near the second incident portion, wherein light from the second light source is guided from back to front within the light guide through the second incident portion, and wherein a portion of the guided light from the second incident portion is wholly reflected by the first projection surface and radiated forward from the radiating portion.

7. The vehicular lamp according to claim 4, wherein the columnar light guide is disposed along the front cover.

8. The vehicular lamp according to claim 5, wherein the columnar light guide is disposed along the front cover.

9. The vehicular lamp according to claim 3, wherein the columnar light guide is disposed along the front cover.

10. A vehicular lamp comprising:

a first light source within a lamp chamber defined by a lamp body and a front cover;

a columnar light guide disposed so as to slant from front to back; and a reflector disposed adjacent to at least a rear side of the columnar light guide, wherein the columnar light guide comprises:

a first incident portion disposed on an end side thereof near the first light source, a stepped portion disposed on a rear surface side thereof in an axial direction and wholly reflects a portion of guided light, and a radiating portion disposed on a front surface side thereof in the axial direction that radiates the wholly reflected light forward, wherein the columnar light guide is disposed so as to guide light from the first light source that is incident through the first incident portion from front to back within the light guide, and wherein the stepped portion is a plurality of generally triangular prisms formed continuous in an extension direction, wherein the stepped portion has, in a cross section that follows an extension axis of the columnar light guide and is parallel to a lamp optical axis, a long first projection surface that extends in the extension direction and a short second projection surface that forms an apex angle with the first projection surface, wherein a portion of light from the first light source that is guided from front to back in the columnar light guide is radiated from the second projection surface and reflected by the reflector, and then incident to another first projection surface and wholly reflected by the second projection surface adjacent to the first projection surface, and subsequently radiated forward from the radiating portion, wherein the first projection surface in the columnar light guide projects forward, wherein the columnar light guide comprises a second incident portion disposed on another end side thereof, the vehicular lamp further comprising a second light source provided near the second incident portion, wherein light from the second light source is guided from back to front within the light guide through the second incident portion, and wherein a portion of the guided light from the second incident portion is wholly reflected by the first projection surface and radiated forward from the radiating portion, wherein the first projection surface is constituted from two flat surfaces, and wherein among the two flat surfaces in the cross section that follows the extension axis of the columnar light guide, where L2 is a side length of the forward flat surface and L1 is a side length of the rearward flat surface, a ratio L2/L1 of the side lengths is set so as to increase from the first incident portion toward the second incident portion.

* * * * *